US011834826B2

(12) United States Patent
White et al.

(10) Patent No.: US 11,834,826 B2
(45) Date of Patent: Dec. 5, 2023

(54) BUILDING FACADE SYSTEM AND METHOD OF FORMING A BUILDING FACADE

(71) Applicant: UBFS LLC, Chicago, IL (US)

(72) Inventors: James Jonathan White, Riverside, IL (US); Edward Mitry Coosaia, Livermore, CA (US); Jason S. Eastwood, Pittsburg, KS (US)

(73) Assignee: UBFS LLC, Chicago, IL (US)

( * ) Notice: Subject to any disclaimer, the term of this patent is extended or adjusted under 35 U.S.C. 154(b) by 0 days.

(21) Appl. No.: 17/847,986

(22) Filed: Jun. 23, 2022

(65) Prior Publication Data

US 2022/0333379 A1 Oct. 20, 2022

Related U.S. Application Data

(63) Continuation of application No. 17/150,713, filed on Jan. 15, 2021, now Pat. No. 11,396,750.
(Continued)

(51) Int. Cl.
*E04B 2/96* (2006.01)
*E04B 1/94* (2006.01)

(52) U.S. Cl.
CPC ..... *E04B 2/967* (2013.01); *E04B 1/948* (2013.01)

(58) Field of Classification Search
None
See application file for complete search history.

(56) References Cited

U.S. PATENT DOCUMENTS 3,205,630 A * 9/1965 Felix ..... E04B 2/7818 52/204.591
3,465,996 A 9/1969 Von Wedel
(Continued)

FOREIGN PATENT DOCUMENTS

GB 2464483 A 4/2010
JP S57112540 A 7/1982
(Continued)

OTHER PUBLICATIONS

International Search Report issued by ISA/US in connection with PCT/US21/13685 dated Apr. 8, 2021.
(Continued)

*Primary Examiner* — Joshua K Ihezie
(74) *Attorney, Agent, or Firm* — Levenfeld Pearlstein, LLC

(57) ABSTRACT

A building facade system which comprises a frame to support a building facade panel, a unified vertical shear blade anchor, a vertical mullion and an angled anchor member. The unified vertical shear blade anchor has a body portion and a flange extending horizontally therefrom. The flange has top and bottom surfaces with the bottom surface having serrations. The vertical mullion is secured by a shear connection to the vertical shear blade anchor. The shear connection between the vertical mullion and the vertical shear blade anchor is formed by a fastener which extends through side portions of the body portion and vertical mullion. The angle member has first and second flanges each having proximal ends joined together and opposing terminal ends. The second flange has a top surface with upwardly projecting serrations. The upwardly projecting serrations are configured for engagement with the downwardly projecting serrations of the vertical shear blade anchor.

9 Claims, 9 Drawing Sheets

Related U.S. Application Data

(60) Provisional application No. 63/064,194, filed on Aug. 11, 2020, provisional application No. 63/055,300, filed on Jul. 22, 2020.

(56) References Cited

U.S. PATENT DOCUMENTS

| | | | | |
|---|---|---|---|---|
| 3,936,986 | A | 2/1976 | Steel | |
| 3,994,107 | A | 11/1976 | Aughuet | |
| 4,073,107 | A * | 2/1978 | Rousseau | E04B 2/88 52/235 |
| 4,483,122 | A * | 11/1984 | Crandell | E04F 13/0808 52/235 |
| 4,782,635 | A * | 11/1988 | Hegle | E04B 2/94 52/235 |
| 5,063,718 | A | 11/1991 | Nonis | |
| 5,077,947 | A * | 1/1992 | Takeda | E04B 2/94 52/235 |
| 5,158,392 | A * | 10/1992 | Takeda | E04B 2/34 52/235 |
| 5,253,459 | A * | 10/1993 | Parinas | E04B 2/96 52/235 |
| 6,598,361 | B2 | 7/2003 | Ting | |
| 6,658,804 | B2 | 12/2003 | Leytes | |
| 6,804,920 | B2 * | 10/2004 | Hogan | E04B 2/96 52/204.593 |
| 7,043,884 | B2 * | 5/2006 | Moreno | E04F 13/0808 52/489.1 |
| 7,562,504 | B2 | 7/2009 | Herbst et al. | |
| 7,644,549 | B2 | 1/2010 | Speck | |
| 7,827,746 | B2 | 11/2010 | Speck | |
| 8,011,146 | B2 | 9/2011 | Krause | |
| 8,484,916 | B2 | 7/2013 | Farag | |
| 8,567,141 | B2 | 10/2013 | Logan | |
| 8,601,762 | B2 * | 12/2013 | Walker, III | E04B 2/96 52/235 |
| 8,615,938 | B2 | 12/2013 | Arbour | |
| 8,955,285 | B2 * | 2/2015 | Fournier | E04B 2/88 52/509 |
| 9,032,681 | B1 | 5/2015 | Brady | |
| 9,175,471 | B2 * | 11/2015 | Ting | E04B 2/90 |
| 9,200,444 | B2 * | 12/2015 | Ra | E04B 2/96 |
| 9,683,367 | B1 | 6/2017 | Ting | |
| 9,752,319 | B1 * | 9/2017 | LeVan | E04B 2/965 |
| 9,896,840 | B2 | 2/2018 | Ting | |
| 10,041,256 | B2 | 8/2018 | Scully et al. | |
| 10,094,111 | B2 | 10/2018 | Levan | |
| 10,202,763 | B2 | 2/2019 | Hogan et al. | |
| 10,202,764 | B2 | 2/2019 | Levan | |
| 10,233,638 | B2 | 3/2019 | Levan | |
| 10,526,791 | B2 * | 1/2020 | Loyd | E04B 1/40 |
| 10,669,709 | B2 | 6/2020 | Zemler et al. | |
| 10,724,234 | B2 | 7/2020 | LeVan | |
| 11,396,750 | B2 * | 7/2022 | White | E04B 1/4107 |
| 2003/0033765 | A1 | 2/2003 | Ting | |
| 2006/0016133 | A1 * | 1/2006 | Speck | E04B 2/90 52/79.1 |
| 2007/0039258 | A1 | 2/2007 | Walker, III | |
| 2010/0257812 | A1 | 10/2010 | Schultz | |
| 2012/0102860 | A1 | 5/2012 | Ander | |
| 2013/0014636 | A1 | 1/2013 | Dehghanyar | |
| 2014/0144093 | A1 * | 5/2014 | Shriver | E04B 1/946 52/407.4 |
| 2015/0135615 | A1 * | 5/2015 | Hogan | E04B 1/40 52/745.1 |
| 2016/0298338 | A1 | 10/2016 | Libreiro et al. | |
| 2017/0254074 | A1 * | 9/2017 | LeVan | E04B 2/965 |
| 2017/0350117 | A1 * | 12/2017 | Hogan | E04B 2/90 |
| 2017/0362826 | A1 * | 12/2017 | LeVan | E04B 2/90 |
| 2018/0334799 | A1 * | 11/2018 | Andresen | E04B 2/96 |
| 2019/0071863 | A1 * | 3/2019 | Ting | E04B 1/4107 |
| 2019/0093349 | A1 * | 3/2019 | LeVan | E04B 2/885 |

FOREIGN PATENT DOCUMENTS

| | | | |
|---|---|---|---|
| JP | S5931344 | A | 2/1984 |
| JP | S61166004 | U | 10/1986 |
| JP | H0346083 | Y2 | 9/1991 |
| JP | H0420889 | Y2 | 5/1992 |
| JP | H04107311 | U | 9/1992 |
| RU | 73909 | U1 | 6/2008 |

OTHER PUBLICATIONS

Written Opinion issued by ISA/US in connection with PCT/US21/13685 dated Apr. 8, 2021.

Hilti, Curtain Wall Facades, Dec. 17, 2018, pp. 1-140, https://www.hilti.sa/content/dam/documents/pdf/meta_ae/brochure-curtain%20wall%20facades%20d9.pdf.

Sharma, Mayank, A Passive Route to Fire Safe Facade Construction, WFM Media Magazine, Dec. 17, 2020, https://wfmmedia.com/firestop-facade-system/.

Halfen GMBH, Halfen HCW Curtain Wall Technical Product Information, 2014, pp. 1-36, Germany.

Precast/Prestressed Concrete Institute, Recommended Practice for Glass Fiber Reinforced Concrete Panels, PCI Manual, p. 31, 4th edition.

Allana, Karim P. et al., Curtain Wall Issues, Problems, and Solutions, 2012 Symposium on Building Envelope Technology, Oct. 22-23, 2012, Pheonix, Arizona.

Muhammad, Ludifa Barau, Systematic Evaluation of Curtain Wall Types, thesis in partial fulfillment of the requirements for the Degree of Master of Science in Architecture at Eastern Mediterranean University, Feb. 2010, Gazimagusa, North Cyrprus.

Pond, Samuel et. al., "The State of Practice of Unitized Curtain Walls ", Structures Congress 2015, Downloaded from ascelibrary.org by University of Birmingham on Aug. 12, 2017.

"Literature Review on Seismic Performance of Building Cladding Systems" A Report to: U.S. Department of Commerce Technology Administration National Institute of Standards and Technology Building and Fire Research Laboratory Gaithersburg, MD 20899, Cladding Research Institute, Emeryville, California, Feb. 1995.

"Signature Series Unit Wall Installation Manual", Oldcastle BuildingEnvelope, Jul. 2013.

"2500 UT Unitwall® System" Kawneer Company, Inc., EC 97911-263, Mar. 2022.

"YUW 750 XT—Unitized Curtain Wall System Detail" YKK AP America Inc., Sep. 13, 2016, Jul. 6, 2015.

* cited by examiner

BUILDING FACADE SYSTEM AND METHOD OF FORMING A BUILDING FACADE

CROSS-REFERENCE TO RELATED APPLICATIONS

The present application is a continuation application and claims the benefit of the filing date of U.S. patent application Ser. No. 17/150,713 filed on Jan. 15, 2021, now allowed, which claims priority to U.S. Provisional Patent Application No. 63/064,194 filed Aug. 11, 2020 and U.S. Provisional Patent Application No. 63/055,300 filed Jul. 22, 2020. Each of the above-identified applications is hereby expressly incorporated by reference in its entirety as if set forth fully herein.

FIELD

Embodiments presented herein relate generally to the field of building facade systems which form an envelope of external facade around buildings such as multi-residence or commercial office buildings, high-rise buildings, towers, skyscrapers and the like. More particularly, embodiments disclosed herein provide a universal building facade system anchored from the building floor structure via a shear supported unified anchor innovation. According to exemplary embodiments, the building facade system presented herein requires fewer field installed parts than conventional facade systems and increases labor efficiency of installation while concurrently providing the ability to apply a traditional fire stop and smoke seal with a notched vertical configuration as required for the safety of building occupants and to meet international and local building codes after installation of the frame onto the floor structure.

BACKGROUND

Two conventional types of building facade systems that are generally known and commonly used are window/hybrid wall and curtainwall. Generally, known curtainwall framework employs a plurality of anchor sub-assemblies. Each subassembly is comprised of roughly half of a two-part large aluminum mating clip, and can include a Jack bolt, and serrated washer. In assembling such systems, one subassembly is typically pre-attached to the building terminal slab end with a first crew of laborers and the second subassembly is mated to the pre-glazed panel by a second crew of laborers. The two subassemblies that make up the whole anchor are joined together when a third crew of laborers joins the pre-glazed panel anchor subassembly installed by the second crew to the subassembly that was attached to the floor slab by the first crew. The pre-glazed panel of such systems can have a plurality of anchor parts attached structurally to vertical structures/mullions in a shear or tensile vector. Both known curtainwall notched and unnotched vertical framework types stop short of interfacing the system with the building floor structure by over an inch, or as much as several inches. Such arrangement unfortunately has been shown to provide a direct fire path between floors within twenty (20) minutes after the fire burns through aluminum horizontals. As such, known curtainwall configurations can present a life safety hazard by allowing vertical fire spread if costly fire stop materials/measures are not added. Other notched curtain walls rely upon a continuous shelf held in tensile which prevents the field application of this traditional critical life safety fire stop measure in the field. Apart from critical fire safety limitations, the unprotected gap allowed by notched curtainwall systems allows for excessive sound to travel upwards to the occupants above.

Some existing curtainwall systems utilize a continuous shelf design. In such a design, a traditional two-hour rated fire stop and a smoke seal may not be able to be installed in the field for the safety of the building occupants which can represent a safety hazard if used on a building. Such a limitation is critical with regard to the issue of firestopping between floors. For the safety and health of the building occupants building codes generally require the implementation of separate firestopping measures, such as fire resistive mineral wool and smoke resistant silicone seals be installed after the panel is affixed to the building to prevent fire and smoke from traveling up the curtain wall between floors. The installation and use of such measures can be expensive, time consuming, and may not be possible with certain continuous-shelf design systems due to the single shelf anchor spanning between vertical members.

By contrast, window wall systems are generally known to be endo bearing fenestration systems provided in combination assemblies and composite units, including transparent vision panels and/or opaque glass or metal panels, which span from the top of a floor slab to the underside of the next higher floor slab—using the below floor slabs as structural support. Window wall system are load bearing directly on the floor slab and is comprised of any number of individual completed window units used to fill a particular opening on a particular floor. Thus, when a window wall system is fully installed within an opening in a building the system performs independently of other window wall systems in the building.

Conventional building window/hybrid wall framework is generally known to employ a plurality of parts comprising a series of site-installed track parts at the top and bottom face of the terminal end of a floor slab to create a confined opening by two crews of laborers. A third laboring crew then insulates and covers the slab edge using a plurality of site installed loose shipped parts. A fourth crew installs pre-glazed units within the confines of the top and bottom track system set by the first laboring crew. Thus, the installation process can be labor intensive. Further, since window walls are endo bearing, the glass aesthetic design is less continuous and more interrupted. Window walls can also be more susceptible to leaking due to the seals around the panels drying out.

In view of the troublesome deficiencies of known curtainwall systems, there is a need in the art for a building facade system that is able to provide improved safety code compliant firestopping and smoke sealing capabilities, as well as better noise reduction, without requiring excessive installation and/or maintenance time and expense. Innovations presented herein, including the use of the unified vertical shear blade anchor, overcomes such deficiencies and eliminates the need for crews associated with preplacement of anchors required in common curtain wall systems.

DETAILED DESCRIPTION

Figure 1:
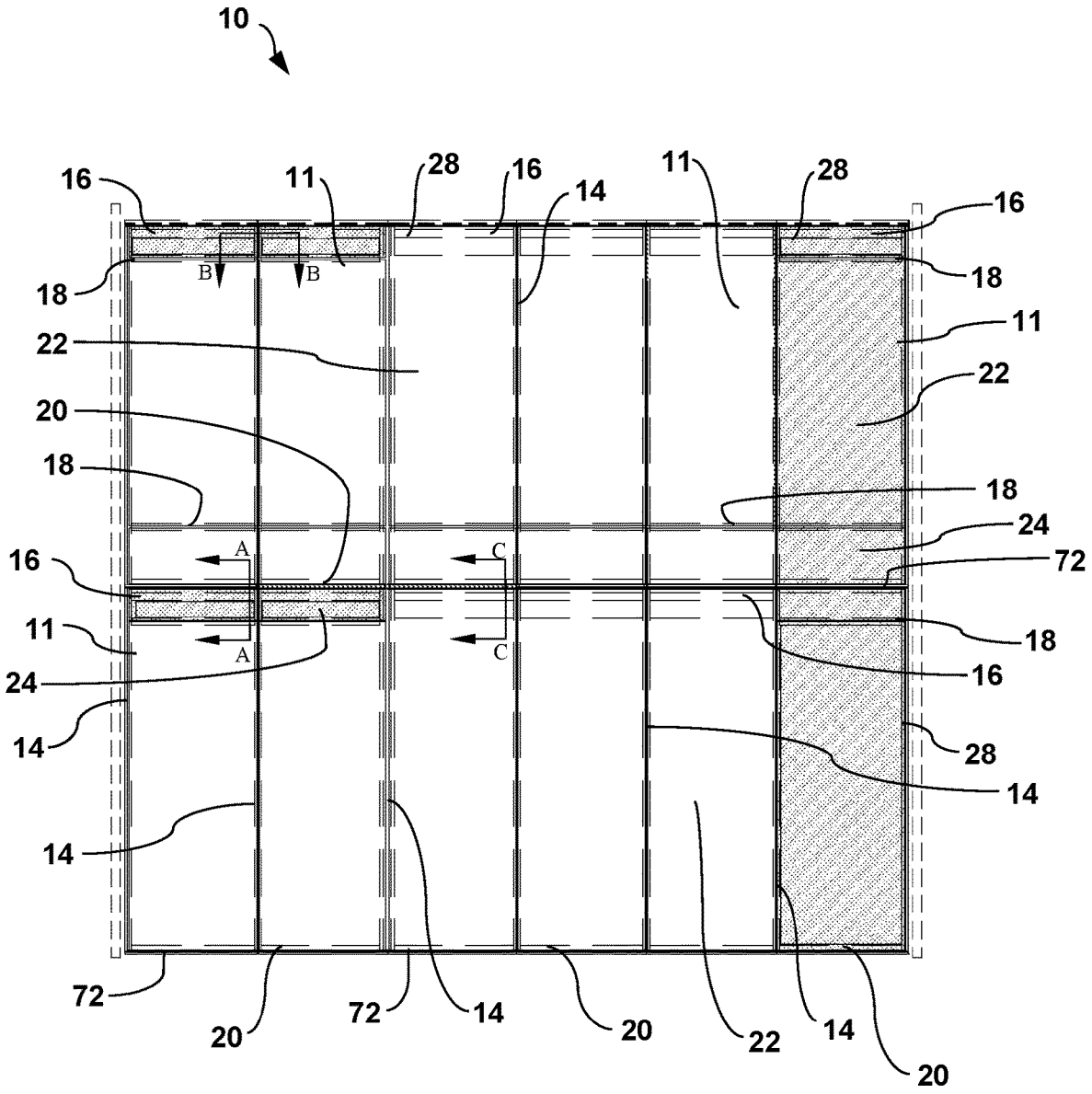
FIG. 1 is a partial front elevation view of a building facade system according to exemplary embodiments provided herein.

While the subject invention is susceptible of embodiment in many different forms, there are shown in the drawings, and will be described herein in specific detail, embodiments thereof with the understanding that the present disclosure is to be considered as an exemplification of the principles of the invention and is not intended to limit the invention to the specific embodiments illustrated.

Embodiments disclosed herein are generally directed to a building facade system and method of forming a building facade system substantially as shown and/or described in connection with the figures and as set forth more fully in the claims. It will be understood from the subject disclose that embodiments presented herein can allow can allow for the floor slab of a building structure to interface more closely with the interior of the building facade system by way of a unified vertical shear blade and an open ended or closed notch within a vertical mullion. It will be appreciated that the disclosed embodiments present an entirely new type of building facade system which provides for the application of fire stop measures as required for the safety of building occupants and also to meet international and local building codes after installation of the frame onto the floor structure. It will further be appreciated that disclosed embodiments provide a highly variable building facade that is practically universal in application. Specific advantages, aspects and novel features of the disclosed system and method, as well as details of the illustrated embodiments thereof, will be more fully understood from the following description and drawings which reference specific embodiments in which the invention can be practiced. The embodiments are intended to describe aspects of the invention in sufficient detail to enable those skilled in the art to practice the invention. Other embodiments can be utilized and changes can be made without departing from the scope of the present invention.

With reference now to the figures, FIG. 1 schematically illustrates a portion of a building facade system 10 constructed in accordance with embodiments provided herein. As shown schematically in FIG. 1, according to exemplary embodiments, building facade system 10 can be comprised of a plurality of unified panel assemblies 11 comprising at least one building facade panel 22, 24 that can be structurally glazed onto a frame assembly comprised of vertical mullions 14 and horizontal members 16, 18, 20. As shown schematically in FIG. 1, unified panel assemblies 11 can be arranged side-by-side along a potion of the exterior of a building structure to form a building facade. According to exemplary embodiments, the building facade can be comprised of substantially vertical mullions 14 and horizontal members 16, 18, 20 supported on vertical mullions 14. Building panels 22, 24 can be aligned both vertically and horizontally side-by-side and end-to-end with seals 72 therebetween to protect the and insulate the interior of the building from precipitation, wind and temperature.

Figure 2:
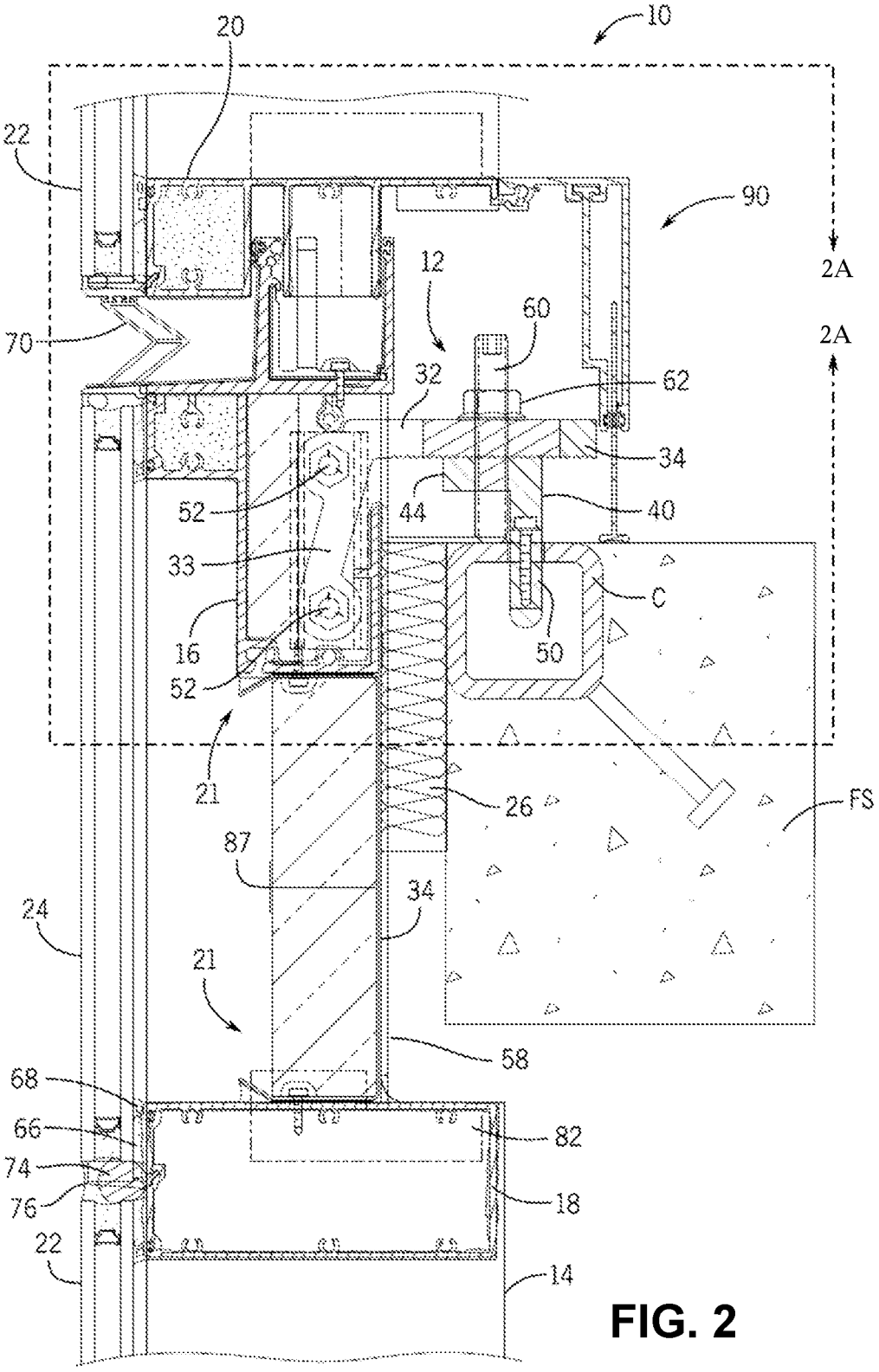
FIG. 2 is a schematic cross-section elevation view of a portion of a building facade system according to exemplary embodiments provided herein taken along line A-A of FIG. 1.
Figure 3:
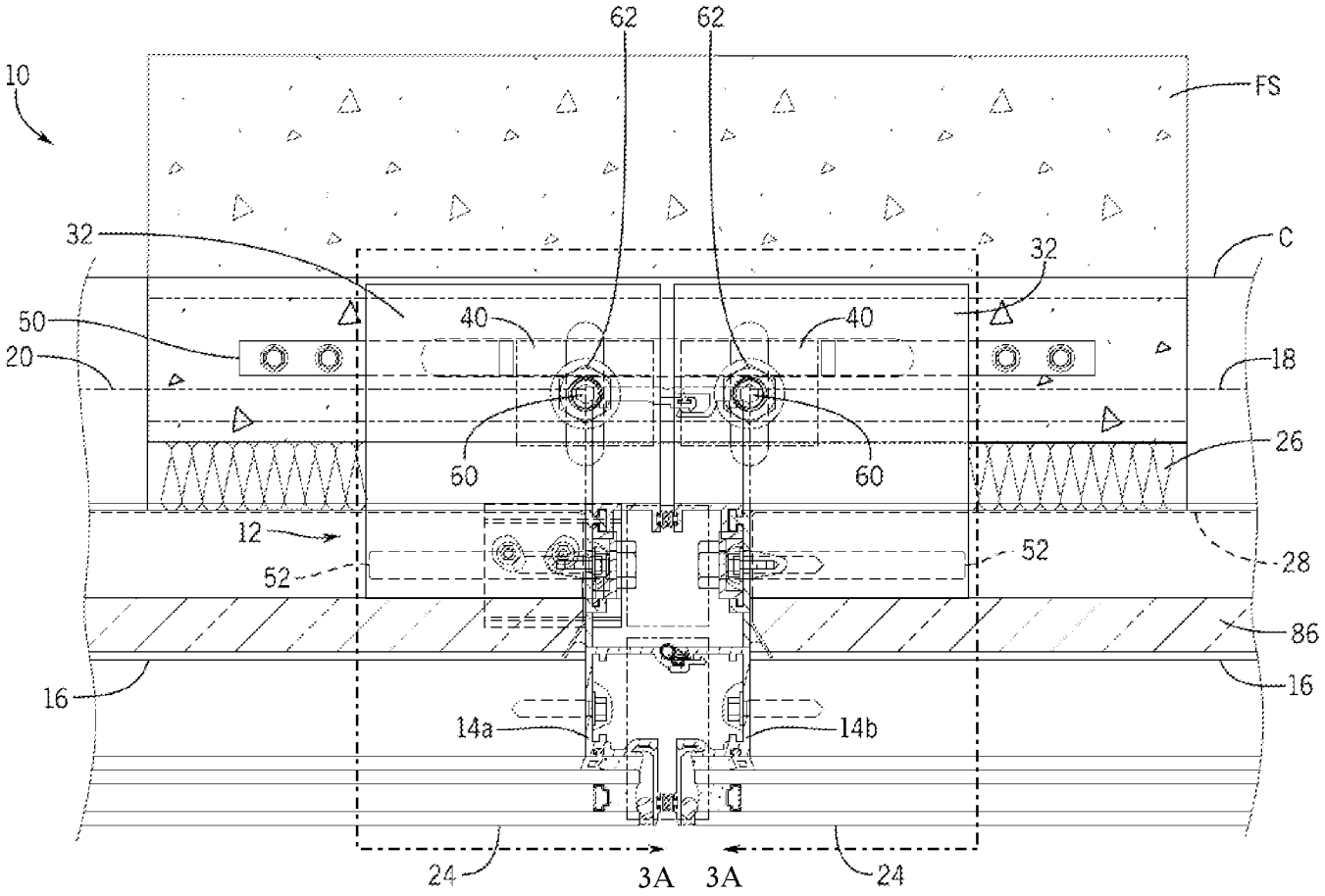
FIG. 3 is a schematic top plan cross-sectional view of a portion of a building facade system according to exemplary embodiments provided herein taken along line B-B of FIG. 1.
Figure 4:
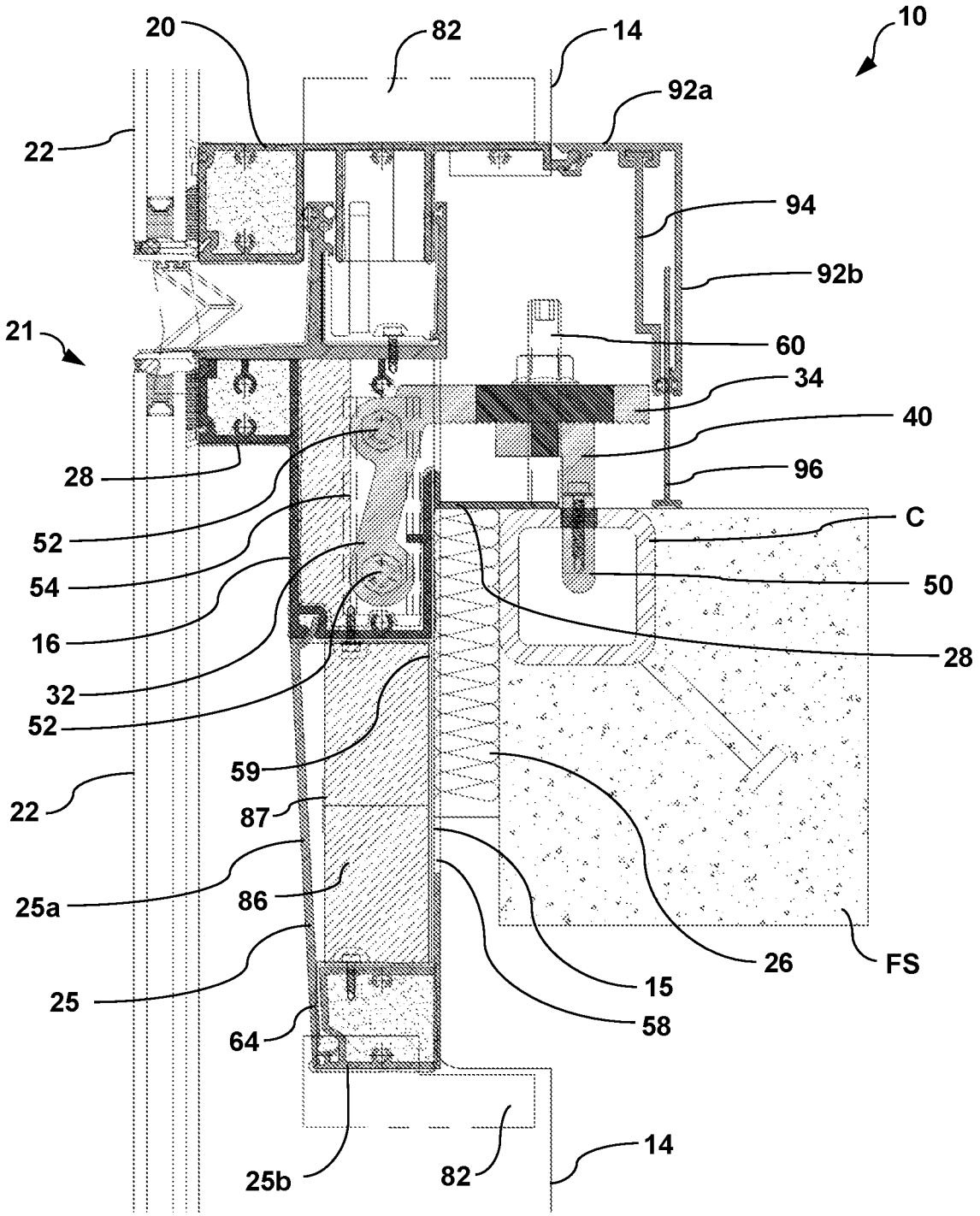
FIG. 4 is a schematic cross-section elevation view of a portion of a building facade system according to exemplary embodiments provided herein taken along line C-C of FIG. 1

FIGS. 2-4 schematically illustrate portions of a building facade system 10 according to exemplary embodiments presented herein and schematically illustrated in FIG. 1. According to exemplary embodiments shown schematically in FIGS. 2-4, the building facade system 10 is shown as being comprised of unified panel assembly 11 installed to the terminal end of a building floor slab FS and can generally comprise an anchor assembly 12, a vertical mullion 14, horizontal members 16, 18, 20 and building facade panels 22, 24. As shown schematically in FIGS. 2-4, building facade system 10 can further comprise an interior trim assembly 90 shown as a floor closure sub-assembly as well as firestopping measures 26, smoke seals 28 and associated fasteners, gaskets, seals, insulation, spacers as will be described further herein.

Figure 3A:
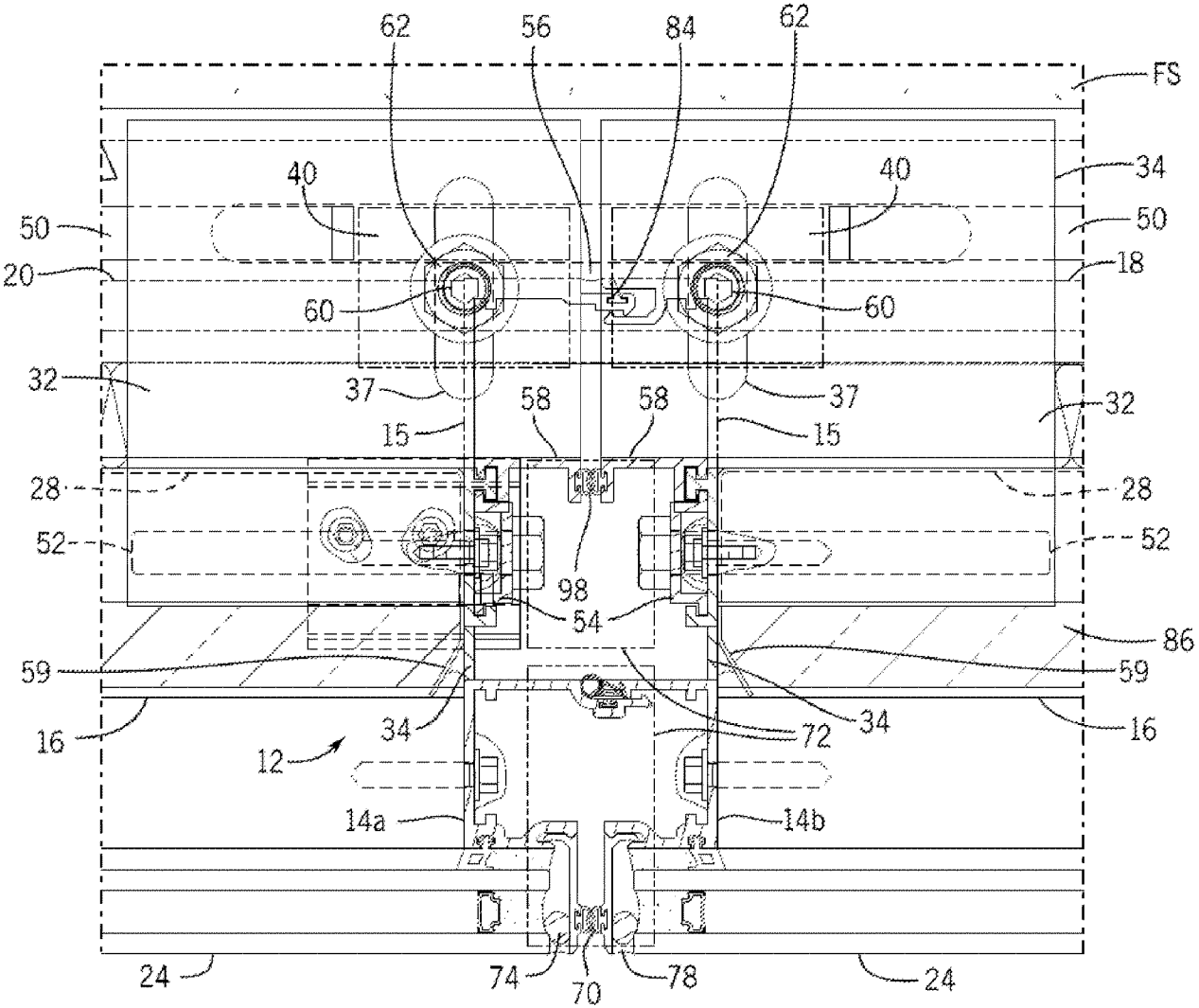
FIG. 3A is a schematic detail top plan cross-section view of a portion of the building facade system shown in FIG. 2.

As best seen in FIGS. 3 and 3A, an exemplary anchor assembly 12 can be comprised of a plurality of unified vertical shear blade anchors 32 laterally spaced-apart from one another and secured to opposing sides of a vertical mullion 14. In particular, vertical mullion 14 can be comprised male and female mullion half members 14*a*, 14*b* that are generally rectangular shaped in cross section and securely snapped together to form vertical mullion 14. According to exemplary embodiments, a unified vertical shear blade anchor 32 can be secured to each mullion half member 14*a*, 14*b*. As is conventionally known, the vertical mullion 14 and horizontal members 16, 18, 20 together form a frame 21 for supporting the building facade panels 22, 24. The frame, and frame components and hardware can largely be comprised of extruded aluminum, although other materials can also be used without limitation. A back pan 59, such as a galvanized steel back pan, can be sealed to the frame 21 on all sides. As best shown schematically in FIGS. 2 and 4, a portion of the vertical mullion halves 14*a*, 14*b* can be provided with a notched section 15 to minimize the distance of the wall of the facade from the terminal face of the floor slab FS and to allow incidental building movements and thermal expansion without compromising the integrity of the building facade. The notched sections 15 can extend along a portion of the length of the vertical mullion and permit the frame 21 to be positioned closer to the terminal edge of the floor slab and provide a space for the application of a fire stop 26 and smoke seals 28.

From the subject disclosure it will be readily understood by persons of ordinary skill in the art that FIGS. 2-4 are schematic illustrations of an exemplary anchor location that can be part of a much larger building facade system 10. In particular, it is generally known that the overall system can encircle an entire exterior of a building structure, or large portions thereof, to span multiple floors to form an exterior facade for the building. Thus, persons of ordinary skill in the art will recognize and appreciate that the portion of the building facade system 10, anchor assembly 12, and other components shown in the FIGS. 2-4 can be provided in pluralities and at numerous locations around the exterior of a building structure in an ordered arrangement. From the subject disclosure it will further be recognized that the building facade system 10 shown and described herein can be comprised of unified panel assemblies 11 that can be shop assembled and require no pre-attachment of anchors to a building floor structure. Such unified assemblies 11 according to exemplary embodiments can generally comprise unified vertical shear blade anchor 32, frame assembly 21 comprised of mullions 14 and horizontal members 16, 18, 20 and a building panel 22, 24 structurally glazed onto the frame assembly.

Figure 5:
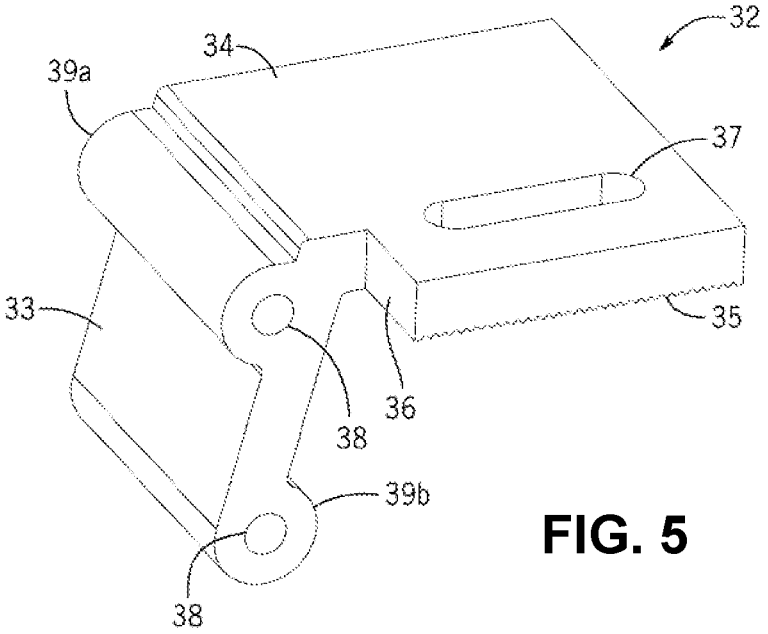
FIG. 5 is a schematic perspective view of an exemplary angle member assembly according to embodiments provided herein.

As illustrated schematically in FIGS. 2-4, according to exemplary embodiments the anchor assembly 12 can be generally comprised of a unified vertical shear blade anchor 32 and angle member 40. FIG. 5 illustrates the unified vertical shear blade anchor 32 according to exemplary embodiments presented herein. As shown schematically in FIG. 5, unified vertical shear blade anchor 32 can have a body portion 33 and a flange 34 extending horizontally from the body portion in a first direction. According to exemplary embodiments, flange 34 can have a proximal end adjacent body portion 33 and an opposing terminal end and opposing top and bottom surfaces. The bottom surface can have downwardly projecting serrations 35 along at least a portion thereof. Serrations 35 can have a sawtooth-type arrangement comprised of a pattern or series of alternating elongated ridges and grooves; the ridges and grooves extending in a second direction across at least a portion of the width of flange 34. As shown in FIG. 5, flange 34 can have a tab 36 extending laterally from a side edge of the main flange section. Tab 36 can be rectangular shaped and extend along at least a portion of the side edge of the main flange section extending all the way to the terminal end of flange 34 as shown in FIG. 5. Flange 34 can also have an opening 37 extending therethrough between the top and bottom surfaces. As shown in FIG. 5, opening 37 can have an elongated or slotted shape having a length extending in the first direction.

According to exemplary embodiments shown schematically in FIG. 5, the body portion 33 of unified vertical shear blade anchor 32 can extend downward from the proximal end of flange 34 and have a top portion adjacent the flange 34 and an opposing bottom portion. As shown in FIG. 5, body portion 33 can slope away from flange 34 as it extends from top to bottom such that the body portion and flange extend away from one another to define an obtuse angle below the flange. As shown in FIG. 5, holes 38 can extend through body portion 33 in a second direction substantially perpendicular to the first direction. As described in further detail below, holes 38 can be configured for receiving fasteners for securing the unified vertical shear blade anchor 32 in shear to a vertical mullion half section 14*a*, 14*b*. As shown in FIG. 5, the holes 38 can have a diameter and circumference only slight smaller than the width of the body portion 33 and the top and bottom portions of the body portion can have bulbous protrusions 39*a*, 39*b* for providing sufficient surrounding area to accommodate holes 38. According to exemplary embodiments provided herein, unified vertical shear blade anchor 32 can be made of extruded aluminum, although it will be understood that it can also be made from other rigid materials without limitation, such as galvanized steel for example.

From the subject disclosure, it will be generally understood and appreciated by persons of ordinary skill in the art that the invention and utilization of a unified vertical shear blade anchor 32 in accordance with embodiments presented herein creates an entirely new variant of building facade systems that is universal in application. Specifically, such innovation can provide the aesthetic contemplated by all prior types of building facade enclosure systems described above in a single system and further provides dramatically improved design freedom within a single unified chassis. This is made possible by the encapsulation of the floor slab that is made possible by the combination of functions between the notch and the innovation of unified vertical shear blade anchor 32. Such capabilities and improvements can be obtained without the need for multiple laboring crews to mate curtainwall framework anchors of the type used with prior curtainwall systems because the frame contains within itself all the required anchor components and eliminates the need to pre-attach anchors to the building while also allowing the installer to install the needed fire safety systems after the frame is affixed to the building. Such capability is not achievable with any known notched curtainwall which instead rely on a single shelf anchor holding the unit in tensile.

Figure 6:
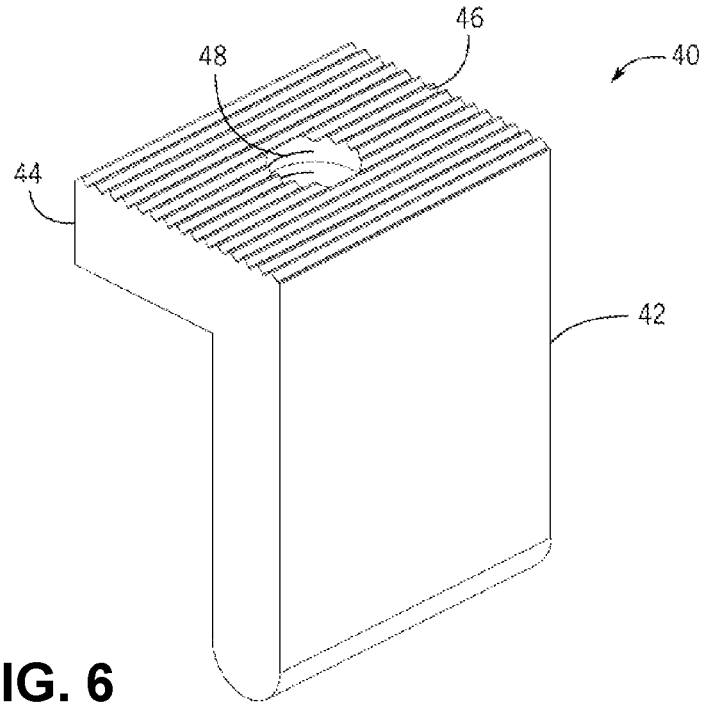
FIG. 6 is a schematic perspective view of an exemplary vertical shear blade anchor according to embodiments provided herein.

FIG. 6 illustrates an exemplary angle member 40 according to embodiments presented herein. As shown schematically in FIG. 6, angle member 40 can generally have an 'L'-shaped configuration formed by substantially perpendicular first and second flanges 42, 44 which set apart from one another at an angle on the order of 90 degrees. According to exemplary embodiments shown schematically in FIG. 6, the first and second flanges 42, 44 can be joined together at their respective proximal ends and can each have an opposing terminal end. As illustrated in FIG. 6, the first and second flanges 42, 44 can be sized differently with the first flange 42 having a longer length than second flange 44. It will be understood however that the flanges 42, 44 can have the same dimensions or can have additional differences, such as different thicknesses or weights and that the sizes, dimensions or other properties of the flanges can be varied to accommodate different loads and floor slab construction tolerances as need be. According to exemplary embodiments provided herein, angle member 40 can be made of extruded aluminum, although it will be understood that it can also be made from other rigid materials without limitation, such as galvanized steel for example.

As shown in FIG. 6, second flange 44 can have a top surface with upwardly projecting serrations 46 along at least a portion thereof. Serrations 46 can have a sawtooth-type arrangement comprised of a pattern or series of alternating elongated ridges and grooves; the ridges and grooves extending in the second direction across at least a portion of the top surface of angle member 40. As described in further detail below, the upwardly projecting serrations 46 of angled member 40 are configured for engagement with the downwardly projecting serrations 35 of the unified vertical shear blade anchor 32. The second flange 44 can also have a threaded opening 48 extending therethrough between the top and bottom surfaces. As shown in FIG. 6, opening 48 can have a generally circular or cylindrical shape, but it will be understood that it can have additional shapes without departing from the scope of embodiments presented herein.

Returning to FIGS. 2-4, according to exemplary embodiments, an elongated fixture such as a steel channel or tube C can be permanently preplaced onto or embedded into the building floor slab FS by means of welding or casting in place. As shown schematically in FIG. 2, channel C can be secured adjacent the terminal end of the floor slab FS such that the outside edge of channel C is flush with the terminal edge of the floor slab and the top surface of channel C is flush with the top edge of the floor slab FS. According to exemplary embodiments shown schematically in FIGS. 2-4, the terminal end of the first flange 42 of angle member 40 can be inserted into an interior portion of elongated channel C and secured therein. Indexing angles 50 can be installed alongside angle member 40 to laterally index angle member 40 within channel C. In such orientation, the first flange 42 of angle member 40 will extend in a substantially vertical direction and the second flange 44 will extend in a substantially horizontal direction as shown in FIGS. 2-4. Indexing angle 50 can be comprised of extruded aluminum or another rigid material.

Engagement of angle member 40 within channel C can serve as a windload anchor in lieu of providing and/or relying on a leveling bolt to extend to the bottom of the channel to act as both a windload and deadload design. The use of angle member 40 in this manner represents a dramatically improved anchor design for building facade systems. For example, such arrangement provides greater surface area contact to improve rotational force and improved performance under seismic loading with easier pinning as needed. Such design can additionally reduce vertical eccentricities from centroid that make the anchor more structurally efficient along the vertical "up-down" adjustable axis. The "L"-shaped wind loaded anchor angle can further act as a compressioned composite when tightened by the female-type fastener to also reduce the horizontal eccentricities from centroid which can make the anchor more structurally efficient along the lateral "in-out" adjustable axis.

According to exemplary embodiments shown schematically in FIGS. 2-4, the body portion 33 of unified vertical shear blade anchor 32 can be secured by a shear connection to a vertical mullion 14, and more particularly to the outside lateral surface of a vertical mullion half 14*a*, 14*b*, by fasteners such as shear bolts 52. According to embodiments presented herein, shear bolts 52 can extend in a second direction and be inserted into holes 38 in the body portion of the unified vertical shear blade anchor 32 and fastened to vertical mullion 14 with associated fasteners. Such attachment can include a bearing insert 54 to attach the shear blade anchor to the vertical mullion 14. Bearing insert 54 can be comprised from extruded aluminum or other ridged material without limitation. Thus, according to exemplary embodiments presented herein, vertical mullion 14 can be secured by shear connection to the unified shear blade anchor 32 with vertical mullion 14 being held in shear to suspend the frame 21 assembly from the building floor slab FS.

As shown in FIGS. 2 and 4, upon installation of a unified anchor assembly and alignment adjacent to a floor slab FS, flange 34 can extend inward and above the terminal edge of floor slab FS with serrations 35 along the bottom side of flange 34 extending downward. According to exemplary embodiments shown schematically in FIGS. 2, 4 and 7, downwardly projecting serrations 35 on vertical shear blade anchor 32 can engage upwardly projecting serrations 46 on the top surface of angle member 40. Such engagement can form anchor assembly 12 and can secure the unified vertical shear blade anchor 32 in the horizontal direction and perpendicular to the terminal edge of the floor slab FS. Anchor assembly 12 is further illustrated in FIG. 7, and engagement between the serrations of angle member 40 and unified vertical shear blade anchor 32 can further support the frame 21 in the desired horizontal position relative to the said floor slab FS and channel C welded onto or cast into the floor structure. More particularly, the relationship of these serrated members, together with the slotted opening through the flange 34 of unified vertical shear blade anchor 32 can permit horizontal in-and-out adjustment of the frame relative to said channel C.

According to exemplary embodiments shown schematically in FIGS. 3 and 3A, a plurality of unified vertical shear blade anchors 32 are shown as being secured adjacent one another to mullion 14. As illustrated in FIGS. 3 and 3A, the plurality of unified vertical shear blade anchors 32 can be secured adjacent one another to opposing mullion half members 14*a*, 14*b* with the tabs 36 of the flanges 34 of unified vertical shear blade anchors 32 being positioned along an interior side or face of mullion half members 14*a*, 14*b*. Thus, the tab 36 along the interior surface of flange 34 of each shear blade anchor can form a notched portion to accommodate the vertical mullion half 14*a*, 14*b*. As shown schematically in FIGS. 3 and 3A, according to exemplary embodiments a gap or space can be provided between adjacent unified vertical shear blade anchors 32, and more particularly between interior surfaces of flanges 34 between tabs 36. The gap can be provided for accommodating a sealant 56 as shown in FIG. 3A.

Figure 7:
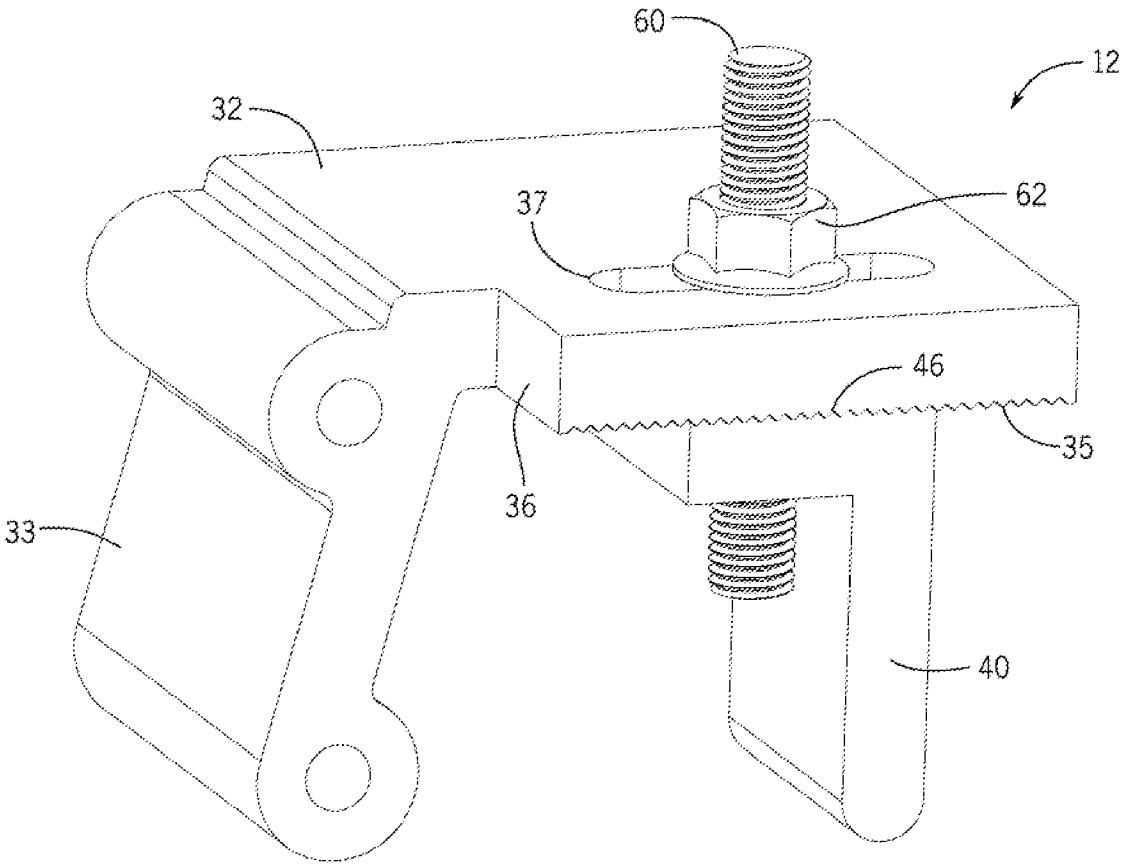
FIG. 7 is a schematic perspective view of an exemplary anchor assembly according to embodiments provided herein.

According to exemplary embodiments shown schematically in FIGS. 2, 3 and 7, openings 48 in angle members 40 can be aligned with the slotted openings of unified vertical shear blade anchors 32 and fasteners such as, for example, threaded leveling bolt anchors 60 can be provided and inserted through the slotted openings in the unified vertical shear blade anchor 32 and threaded through the threaded opening 48 of angle member 40. As shown schematically in the figures, leveling bolt anchors 60 can be provided with corresponding female-type fasteners such as, for example, high strength serrated flange locknuts 62 which can be threaded upon and secured to leveling bolt anchors 60 above the top surface of the flanges of unified vertical shear blade anchors 32. Fasteners or leveling bolt anchors 60 can extend in a third direction through the flanges 40 of unified vertical shear blade anchors 32 and the second flanges 42 of angle members 40. As shown schematically in FIGS. 2-4, the terminal ends of leveling bolts 60 can be seated upon a top surface or flange of channel C or a separate plate or angle bracket seated upon the top surface of the channel C. According to exemplary embodiments, the turning of leveling bolt anchors 60 against the top of the channel C can allow for vertical adjustment of the unified vertical shear blade anchors 32 which can also commensurately move the frame 21 in positive or negative elevation from an initial nominal placement of the frame relative the floor structure FS.

According to exemplary embodiments, the distance from top of said leveling bolts 60 to the top surface of channel C can be fixed. As shown schematically in FIGS. 2-4, the unified vertical shear blade anchor 32 can rest on top of said angle member 40 which can be engaged to the top portion of channel C. The female-type fasteners can be adjustable up and down bearing on threads on said leveling bolts 60 thereby adjusting said unified vertical shear blade anchor 32 by moving the said below angle member 40.

According to exemplary embodiments shown schematically in FIG. 2, a plurality of horizontal members 16, 18, 20 can be supported from vertical mullions 14. Such horizontal members can be made from extruded aluminum or other rigid materials without limitation and can form frame 21 for supporting building facade panels 22, 24 which can be structurally glazed to frame 21 and delivered to a building site as a prefabricated unified anchor panel assembly 11. Horizontal member 16 can comprise, for example, an extruded aluminum head member secured to vertical mullion 14 in an area adjacent or around unified vertical shear blade anchor 32. Horizontal member 20 can comprise, for example an extruded aluminum sill member secured to a lower portion of a vertical mullion 14 and above a head member 16 supported from a below floor slab FS. According to exemplary embodiments, horizontal sill member 20 can serve as the top portion of a windload connection load path for the frame below. Horizontal member 18 can comprise, for example, an extruded aluminum spandrel panel support member secured along the length of vertical mullion 14 below head member 16 and above horizontal sill member 20. As shown schematically in FIG. 2, adjacent vertical mullions 14, horizontal head member 16 and horizontal spandrel panel support member 18 can create a frame to support building facade panel 24, such as a spandrel cover panel to cover the spandrel area around the terminal end of a building floor slab FS.

Head member 16 shown in FIGS. 2 and 4 can serve as the bottom portion of a windload connection load path of the frame above. As best shown schematically in FIGS. 2, 2A and 4, head member 16 can have a top blade portion(s) 16*a* configured for engaging a lower portion of the sill member 20 from the floor above. Engagement can be via rigid anchor connection to suspend or support head member 16 from sill member. An angle member 17 can be provided between or adjacent the top blade portion(s) 16*a* of head member 16. Angle member 17 can be comprised of extruded aluminum or other rigid material and have a notch to index the units above, namely downwardly projecting flanges 20*a* of sill member 20. Rigid PVC pressure spacers 80 and pressure equalization air seal gaskets 84 can be seated upon head member 18 near the terminal ends of top blade portion(s) 16*a*, or along downwardly projecting flange(s) 20*a* of sill members, so as to be engagingly received between top blade portion(s) 16*a* of head member 16 and downward projecting flanges 20*a* of sill members 20. Pressure spacers 80 and air seal gaskets 84 and can form a seal between the horizontal head members 18 and the sill members 20 from the floor above. A vertical interior air seal 58, such as an extruded aluminum vertical interior air seal, can be provided along the interior section of vertical mullion 14 for placement between mullion 14 and the terminal edge of floor slab FS. It will be understood that the seals formed by pressure spacers 80, equalization air seal gaskets 84, and vertical interior air seal 58 can have air and water-resistant capabilities.

According to exemplary embodiments, air seals 82, such as closed cell foam block air seals can be provided and sealed in place by silicone to framing members such as horizontal sill members 20 and spandrel panel support members 18. Such air seals can provide additional insulation to the building facade system 10 to slow the transfer of heat through the system and reduce heat loss, gain and provide additional sound attenuation. As shown schematically in FIGS. 2, 2A and 4, embodiments of the building facade system presented herein can include building facade insulation such as semi-rigid mineral wool 86 which is conventionally used with traditional curtainwall systems. According to embodiments specifically presented herein, such semi-rigid mineral wool insulation 86 can be provided around portions of the frame 21 including alongside at least a portion of the vertical mullions 14 between the horizontal head members 16 and spandrel panel support members 18. Semi-rigid mineral wool insulation 86 can also be provide within the horizontal head members 16 outside and adjacent to the body portion 34 of unified vertical shear blade anchor 32. The semi-rigid mineral wool insulation 86 can provide additional insulation to the building facade system 10 to slow the transfer of heat through the system and reduce heat loss or gain. Weld pins 87 can be used to secure semi-rigid mineral wool insulation 86 to frame 21.

Frame seal 64 can be used to seal and secure spandrel cover panel 24 to the head member 16 and corresponding frame and a primary seal 66, such as structural silicone and a silicone backer gasket 68 can be used to seal and secure spandrel cover panel 24 to the spandrel panel support member 18 and corresponding frame. Likewise, adjacent vertical mullions 14, horizontal spandrel panel support member 18 and horizontal sill member 20 can support building facade panel 22, such as an infill panel. Primary seal 66, such as structural silicone and a silicone backer gasket 68 can be used to seal and secure infill panel 22 to the spandrel panel support member 18 and horizontal sill member 20. It will be understood that building panels 22, horizontal members 16, 18 and 20, vertical mullions 14, unified vertical shear blade anchor 32 can be provided as a unified panel assembly 11 that can be delivered to the building site with a corresponding angled anchor member 40 for installation without the need to pre-attach anchors to the edge of the floor slab FS. Instead, panel assembly 11 can be positioned at the appropriate installation location on the building structure and angled anchor member 40 can be engaged to channel C with corresponding adjustments being made relative anchor member 40 and unified vertical shear blade anchor 32 and the anchor assembly being secured via leveling bolt anchors 60. It will be understood that such prefabricated unified design configuration can drastically reduce installation time and costs while also enabling the placement of fire prevention measures and smoke seals.

According to exemplary embodiments presented herein, infill panels 22 can be configured to extend between the spandrel cover panels 24 and enclose the building interior space between successive floor slabs FS. Infill panels can be comprised of vision glass which can be transparent, opaque, tinted, translucent, reflective and/or can be comprised of any other material selected from a group consisting of solid, perforated or patterned, steel, aluminum, glass, gfrc, porcelain, sintered stone, stone and polymers. Infill panels 22 can further be insulated and/or be comprised of one or more layers and can be different dimensions or thicknesses as needed or desired. According to exemplary embodiments, spandrel cover panels 24 can be configured to extend between the infill panels 22 and cover the spandrel area around the terminal end of a building floor slab FS. Spandrel cover panels 24 can be comprised of insulating spandrel glass which can be transparent, opaque, tinted, translucent, reflective and/or can be comprised of any other material selected from a group consisting of solid, perforated or patterned, steel, aluminum, glass, gfrc, porcelain, sintered stone, stone and polymers. Facade panels 22, 24 which can be structurally glazed to frame 21 including vertical mullions 14 and horizontal members.

According to exemplary embodiments shown schematically in FIG. 4, at least a portion of building facade system 10 and frame assembly 21 can be provided without horizontal sill member 20 so as to eliminate or bypass a horizontal attachment location at or around the bottom of floor slab FS and enable the use of a longer extended continuous building panel 22. It will be recognized that such design configuration can provided a more desirable streamlined and continuous exterior aesthetic and floor to ceiling vision glass without requiring a separate spandrel cover panel adjacent the exterior edge of floor slab FS. According to exemplary embodiments shown schematically in FIG. 4, building facade system 10 can have a valance 25 made from extruded aluminum or other rigid material as desired. Valance 25 can be located inside building panel 22 so as to be positioned between building panel 22 and at least a portion of the terminal edge of floor slab FS and can provide an aesthetic benefit to hide or obscure the terminal edge of a floor slab FS. As shown schematically in FIG. 4, valance 25 can have a cover 25*a* and base 25*b* made from extruded aluminum or other rigid material. Valance cover 25*a* can have a top portion that is securable to a bottom portion of horizontal head member 16, such as for example by a snap-fit connection and can extend downwardly from head member 18 at or below an elevation adjacent the bottom of floor slab FS. Valance base 25*b* can be secured to outside surfaces of vertical mullion 14 and can engage the lower portion of valance cover 25A. A frame seal 64, fire proofing and/or fluid applied liquid smoke seal 15 can be provided around valance base 25*b* as shown in FIG. 4.

According to exemplary embodiments shown schematically in FIGS. 2, 2A and 4, a space can be defined between the bottom of infill panels 22 and the top of a below spandrel cover panel 24. A gasket 70 such as a rainscreen stack gasket and seal 72 such as a silicone boot seal set in a bed sealant can be set or received within such space. A weather seal and backer rod 74, extruded aluminum setting block chair and silicone glass setting block 76, and a silicone compatible perimeter thermal isolating edge adaptor 78 can be provided between the building facade panels 22, 24 and gasket 70 to seal and secure the exterior building facade against weather and have air and water resistant capabilities.

Figure 2A:
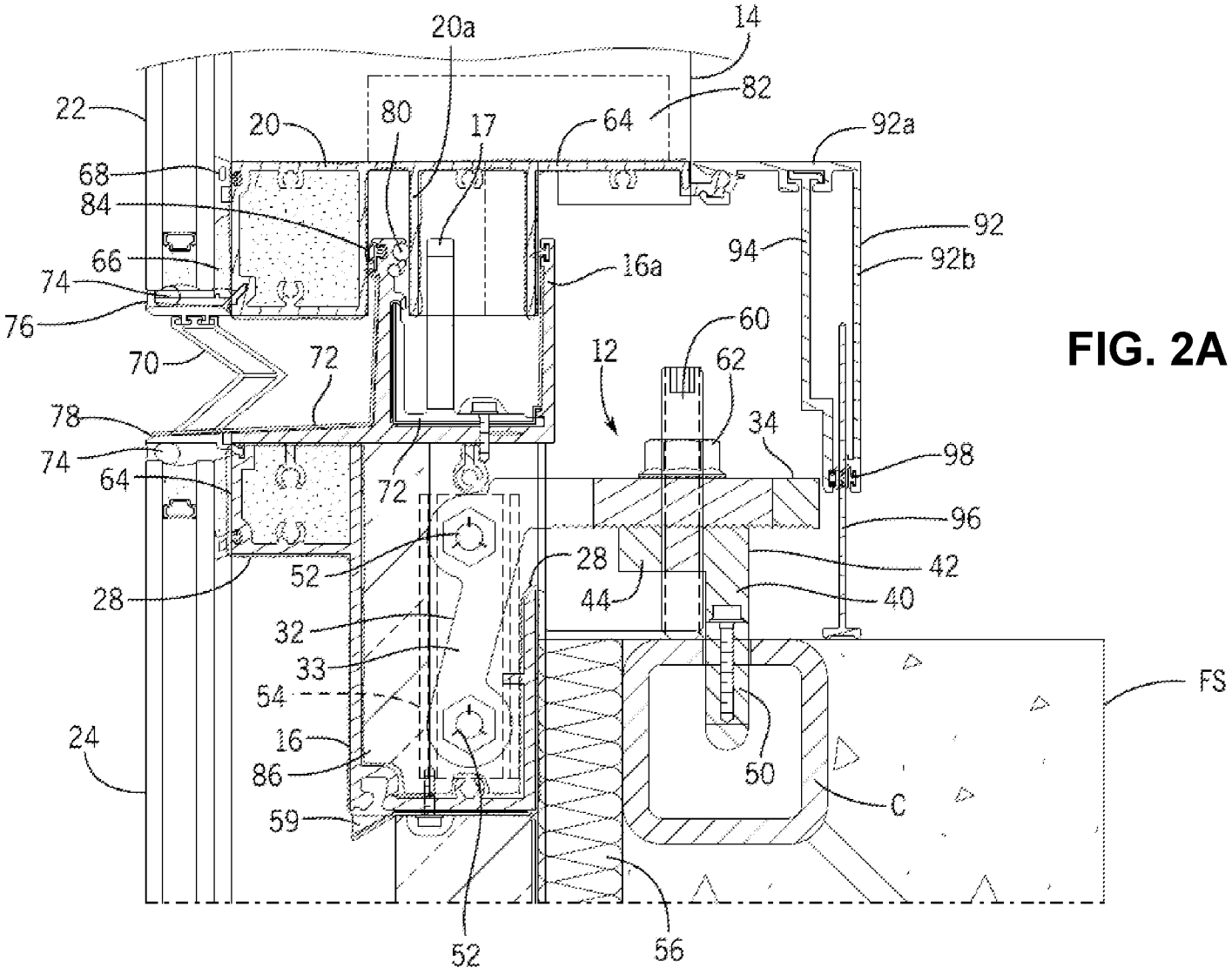
FIG. 2A is a schematic detail cross-section elevation view of a portion of the building facade system shown in FIG. 1.

According to exemplary embodiments as best shown schematically in FIGS. 2, 2A and 4, horizontal sill member 20 can have a top portion that can extend inward from the infill panel 22 towards the building structure and cover at least a portion of an area above the flange 34 of unified vertical shear blade anchor 32. As shown schematically in FIGS. 2, 2A and 4, the top portion of horizontal sill member can have an inside edge configured for attachment of an interior trim assembly 90. Interior trim assembly 90 can have an interior trim body 92 comprising a top panel 92*a* and interior panel 92*b*. The top panel 92*a* of interior trim body 92 can be configured to be secured, such as for example by snap-fit connection, to the inside edge of the horizontal sill member 20 and extend inward to an opposing inside edge. As shown schematically in FIGS. 2, 2A and 4, top panel 92*a* can be substantially horizontal and interior panel 92*b* can extend substantially vertically downward from the inside edge of top panel 92*a*. Persons of ordinary skill in the art will recognize and appreciate that the size and shape of interior trim body 92 and/or configuration of panels 92*a*, 92*b* can be modified without limitation without departing from the novel scope of embodiments presented herein.

As shown schematically in FIGS. 2, 2A and 4, interior trim assembly 90 can have a trim support member 94 and a trim index 96. Trim assembly 90 including trim body 92, trim support member 94 and trim index 96 can be made from extruded aluminum and/or other rigid materials without limitation, can be configured to be installed after the frame 21 and anchor assembly 10 are secured in place and after all positional adjustments to the anchor assembly are made. As illustrated, at least a portion of trim support member 94 can extend downward and away from the top panel of trim body 92 and substantially parallel to interior panel 92*b*. Trim index 96 can be provided between trim support member 94 and interior panel 92*b* and a gasket 98 such as a friction or compression gasket can be seated between inside edges of trim support member 94 and interior panel 92*b*. According to exemplary embodiments best shown schematically in FIGS. 2, 2A and 4, trim index 96 can be vertically adjustable and can be slidably engaged through gasket 98 to seal an opening or space between the top surface of the floor slab FS and the terminal end of the interior trim panel 92*b*. Interior finish gaskets 98 and trim index 96 can be provided to accommodate incidental building movements and concrete tolerances. According to exemplary embodiments shown schematically in the figures, trim assembly 90 including trim body 92, trim support member 94, trim index 96 and gaskets 98 can be removable to enable access to blade anchors 25, 29, angled anchor member 23 and fasteners 22 if desired.

As shown schematically in FIGS. 2-4, exemplary embodiments of the facade system 10 can comprise fire and smoke-resistant seals and insulation to further prevent fire and smoke from spreading between floors. According to exemplary embodiments shown schematically in FIGS. 2-4, fire safing 26 can be provided along the interior notched section 15 of vertical mullion 14 for placement between the interior side of mullion and the terminal edge of floor slab FS. Such fire safing 15 can better prevent the spread of smoke and fire through the space between the frame and the exterior of the building structure so that fire is less able to spread between floors. Persons of ordinary skill in the art will recognize and appreciate that the unified vertical shear blade anchor 32 in cooperation with the notched mullion 14 can enable the use of fire safing 15 as shown and described herein which cannot be provided with conventional curtainwall systems which require fire stopping measures and extra finishing after the system is installed. According to exemplary embodiments shown schematically in FIGS. 2-4, a smoke seal 15, such as a fluid-applied liquid smoke seal can also be provided. Smoke seal 15 can be provided above at least a portion of fire safing 15 forming a seal between an interior portion of horizontal head member and the top of channel C so as to seal the space between the interior edge of vertical mullion 14 and the terminal edge of slab from the space above the floor slab FS. Together with fire safing 15, the smoke seal 13 can prevent the spread of smoke between floors through the space between the frame and exterior of the building.

Utilization of the unified vertical shear blade anchor 32 in accordance with embodiments described herein can enable the building facade system to conform to building fire code requirements calling for a traditional two (2) hour rated fire stop and smoke seal. The invention and utilization of a site indexable floor slab interface trim in accordance with the system described herein permits site adjustability of the trim to cover the gap left at the terminal top face of the slab by concrete that is not uniform without the use of an unsightly caulk joint as is required by other notched vertical curtainwalls. The unified vertical shear blade anchor in accordance with disclosed embodiments further allows for fewer installers to complete the enclosure of the building structure by eliminating the need for a separate plurality of parts to be added to the terminal end of the floor slab as generally required in traditional curtainwall systems.

Figure 8:
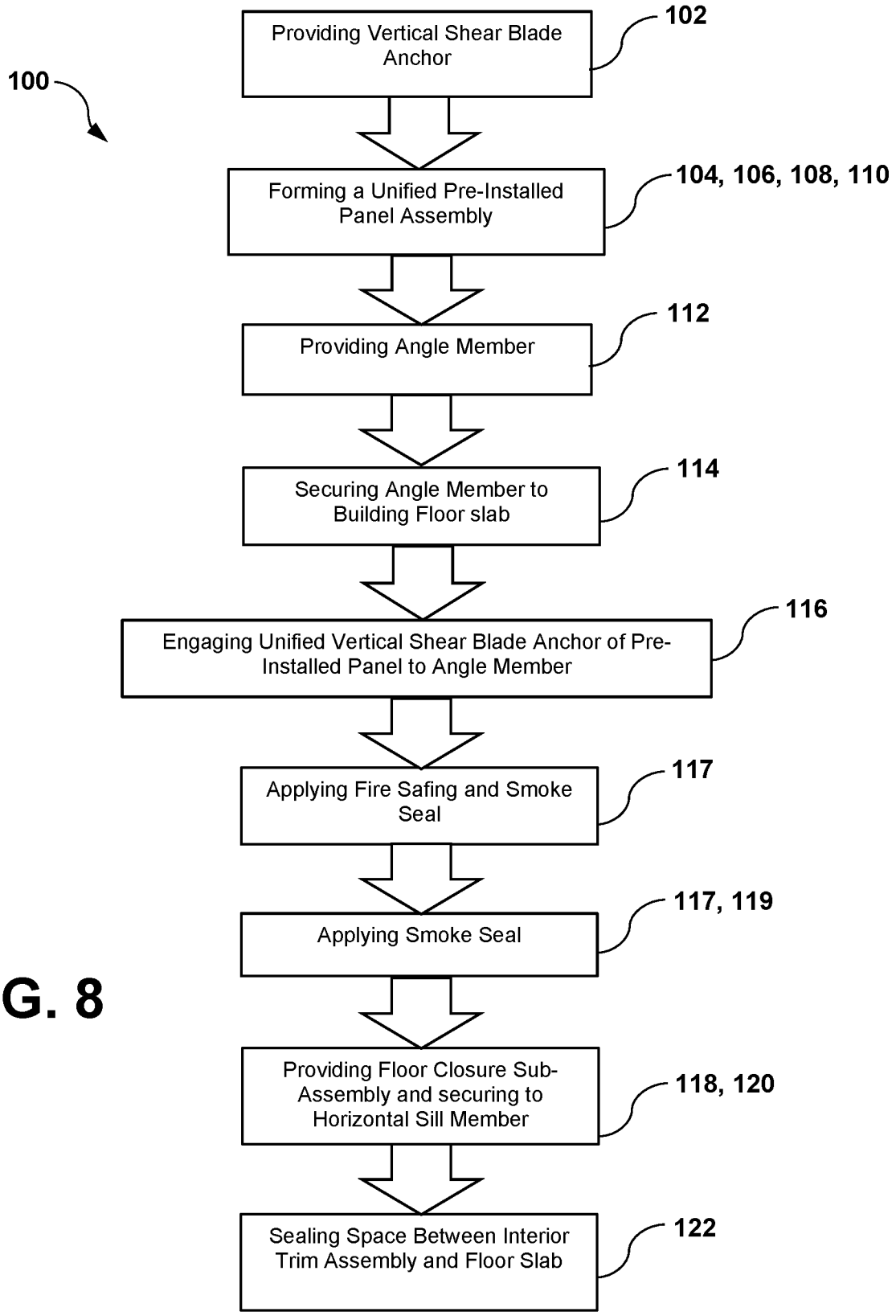
FIG. 8 is a flow diagram of illustrating exemplary steps of a method for installing a building facade system according to embodiments provided herein.

According to exemplary embodiments shown schematically in FIG. 8, a method 100 of forming a building facade system is provided herein. As shown in FIG. 8, the method can comprise providing 102 a unified vertical shear blade anchor having a body portion and a flange extending horizontally therefrom in a first direction. According to exemplary embodiments, the flange can have opposing top and bottom surfaces with the bottom surface having downwardly projecting serrations along at least a portion thereof. The serrations can extend in a second direction substantially perpendicular to the first direction. According to exemplary embodiments, the method can comprise forming 104 a unified pre-installed panel assembly by coupling 106 the unified vertical shear blade anchor to a vertical mullion, coupling 108 the vertical mullion to at least one horizontal support member to form a frame assembly and structurally glazing 110 a building panel to the frame assembly. As shown schematically in FIG. 8, the method 100 can comprise providing 112 an angle member having first and second flanges each having proximal ends joined together and opposing terminal ends. The first and second flanges can extend substantially perpendicular to one another with the second flange having a top surface with upwardly projecting serrations along at least a portion thereof. The upwardly projecting serrations can extend in the second direction. The method 100 can further comprise securing 114 the angle member to a building floor slab and engaging 116 the unified vertical shear blade anchor of the pre-installed panel assembly to the angle member so as to couple the pre-installed panel assembly to the floor slab. The engagement between the angle member and unified vertical shear blade anchor can be made by securing a fastener through the flange of the vertical shear blade anchor and the second flange of the anchor member and engaging at least some of the downwardly projecting serrations of the vertical shear blade anchor with at least some of the upwardly projecting serrations of the anchor member.

As shown schematically in FIG. 8, the method 100 can also comprise securing 106 the unified vertical shear blade anchor by shear connection to a vertical mullion configured for supporting horizontal members. According to exemplary embodiments, the vertical mullion and horizontal members can comprise a frame for supporting building facade panel to form the building facade. Securing of the vertical shear blade anchor by shear connection to the vertical mullion can comprise coupling the body portion of the vertical shear blade anchor to an outside lateral surface of the vertical mullion. According to exemplary embodiments, such coupling can comprise the use of a fastener extending in the second direction through a portion of the body portion and vertical mullion. According to exemplary embodiments shown schematically in FIG. 8, the method 100 can also comprise securing 108 the horizontal members to the vertical mullion to form the frame and securing 110 the building facade panel to the frame by way of structural glazing for example. The assembly when fastened together can provide a compressioned anchor for a building facade system.

Methods according to exemplary embodiments shown schematically in FIG. 8 can further comprise applying 117 fire safing along an interior notched section 15 of vertical mullion 14 between the interior side of mullion and the terminal edge of floor slab FS and applying 119 a smoke seal such as a fluid-applied liquid smoke seal, above at least a portion of the firesafing between an interior side of the horizontal head member and the top surface of channel C. The smoke seal can form a seal between the horizontal head member and building floor slab.

According to exemplary embodiments shown schematically in FIG. 8, exemplary methods can further comprise providing 118 a floor closure sub-assembly having a vertically adjustable interior trim angle held in place by compression of adjacent gaskets wherein the adjustable interior trim angle is slidably adjustable in a substantially vertical direction to interface an interior finish of the building floor slab. Methods provided herein can comprise securing 120 the floor closure sub-assembly to at least one of the horizontal members of the unified pre panel assembly to provide an interior trim assembly for the building facade system. According to exemplary embodiments, the method can further include sealing 122 an opening or space between the top surface of the floor slab FS or interior floor surface and the interior trim assembly by slidably adjusting an interior trim index in a substantially vertical direction towards the floor slab.

From the foregoing, it will be observed that numerous variations and modifications may be affected without departing from the spirit and scope of the invention. It is to be understood that no limitation with respect to the specific apparatus illustrated herein is intended or should be inferred. It is, of course, intended to cover by the appended claims all such modifications as fall within the scope of the claims. From the foregoing, it will be seen that this invention is one well adapted to attain all the ends and objects hereinabove set forth together with other advantages which are inherent to the structure. It will be understood that certain features and sub combinations are of utility and may be employed without reference to other features and sub combinations. Since many possible embodiments of the invention may be made without departing from the scope thereof, it is also to be understood that all matters herein set forth or shown in the accompanying drawings are to be interpreted as illustrative and not limiting.

Further, logic flows depicted in the figures do not require the particular order shown, or sequential order, to achieve desirable results. Other steps may be provided, or steps may be eliminated, from the described flows, and other components may be added to, or removed from the described embodiments.

What is claimed is:

1. A method of forming a building facade system comprising:

providing an anchor having a flange extending horizontally in a first direction and a body portion having a segment extending downward from a proximal end of the flange, the flange having serrations along at least a portion thereof;

providing an angle member having first and second flanges each having proximal ends joined together and opposing terminal ends, the first and second flanges extending substantially perpendicular to one another, the second flange being configured for engagement with the flange of the anchor by way of a vertically-oriented member coupling the flange of the anchor and the angle member, the angle member being securable to a building floor slab and supporting the anchor thereon:

forming a unified panel assembly by coupling the anchor to a vertical mullion, coupling the vertical mullion to at least one horizontal support member to form a frame assembly and structurally glazing a building panel to the frame assembly, the coupling of the anchor to the vertical mullion being achieved by making a mechanically fastened connection by securing the body portion of the anchor to an outside lateral surface of the vertical mullion by inserting a fastener through the body portion and a side of the vertical mullion;

securing the angle member to a building floor slab, and installing the unified panel assembly to a building structure by engaging the angle member with the anchor of the unified panel assembly, said engagement being made by coupling the vertically-oriented member to the flange of the anchor.

2. The method of claim 1 further comprising applying fire safing material along at least a portion of an interior notched section of the vertical mullion and a terminal edge of the floor slab and applying a smoke seal above at least a portion of the fire safing material to seal a space between the interior notched section of the vertical mullion and the terminal edge of the floor slab.

3. The method of claim 1 further comprising installing a floor closure sub-assembly to an interior portion of the at least one horizontal support member and in an area above at least a portion of the floor slab, the floor closure sub-assembly forming an interior trim assembly having a vertically adjustable interior trim index extendable towards the floor slab.

4. The method of claim 1 further comprising providing a plurality of spaced apart anchors, each of the plurality of spaced apart anchors suspending the vertical mullion in shear upon the unified panel assembly being installed to the building structure.

5. The method of claim 1 wherein the building panel structurally glazed to the frame assembly is at least one of a slab edge cover and an infill panel.

6. The method of claim 1 wherein the coupling of the vertical mullion to at least one horizontal support member comprises fastening the horizontal member in shear to the vertical mullion.

7. The method of claim 5 further comprising creating at least one of a watertight and non-watertight barrier by attachment of the infill panel to the frame assembly.

8. The method of claim 1 further comprising forming a slotted opening extending through the flange of the anchor, the slotted opening having a length extending horizontally in the first direction to permit horizontal adjustment of the building facade system.

9. The method of claim 5 wherein the infill panel comprises a material selected from a group consisting of solid, perforated or patterned, steel, aluminum, glass, glass fiber-reinforced concrete ("gfrc"), porcelain, sintered stone, stone and polymers.

* * * * *